US010500879B2

(12) United States Patent
Kano

(10) Patent No.: US 10,500,879 B2
(45) Date of Patent: Dec. 10, 2019

(54) PRINTING APPARATUS

(71) Applicant: Brother Kogyo Kabushiki Kaisha, Nagoya-shi, Aichi-ken (JP)

(72) Inventor: Yasutoshi Kano, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/136,336

(22) Filed: Sep. 20, 2018

(65) Prior Publication Data

US 2019/0299682 A1 Oct. 3, 2019

(30) Foreign Application Priority Data

Mar. 30, 2018 (JP) ..... 2018-066935

(51) Int. Cl.
*B41J 25/304* (2006.01)
*B41J 2/335* (2006.01)

(52) U.S. Cl.
CPC ..... *B41J 25/304* (2013.01); *B41J 2/335* (2013.01)

(58) Field of Classification Search
CPC ..... B41J 25/304; B41J 2/335
See application file for complete search history.

(56) References Cited

U.S. PATENT DOCUMENTS 6,015,211 A * 1/2000 Kinoshita ..... B41J 2/16547 347/109
8,937,634 B2 1/2015 Morgan et al.
10,086,632 B1 * 10/2018 Kondo ..... B41J 2/335

FOREIGN PATENT DOCUMENTS

JP 2002-264398 A 9/2002

* cited by examiner

*Primary Examiner* — Lamson D Nguyen
(74) *Attorney, Agent, or Firm* — Banner & Witcoff, Ltd.

(57) ABSTRACT

There is provided a printing apparatus including: a thermal head having a plurality of heating elements arranged in a first direction; a first engaging member; a head holder having a second engaging member which is configured to engage with the first engaging member so that the thermal head is rotatable about a first axis line extending in the second direction, the head holder holding the thermal head in a posture in which the plurality of heating elements are oriented in a third direction; a pair of urging members each having an end projecting toward the thermal head; a contacting member with which the end of each of the pair of urging members is brought into contact; and a locking part which locks the end of each of the pair of urging members.

6 Claims, 7 Drawing Sheets

PRINTING APPARATUS

CROSS REFERENCE TO RELATED APPLICATION

The present application claims priority from Japanese Patent Application No. 2018-066935 filed on Mar. 30, 2018 the disclosure of which is incorporated herein by reference in its entirety.

BACKGROUND

Field of the Invention

The present disclosure relates to a printing apparatus.

Description of the Related Art

In a printing apparatus of a thermal transfer type using a thermal head, it is preferred that pressing force is applied uniformly with respect to an ink ribbon in order to ensure the print quality. There is a conventionally known printing apparatus of the thermal transfer type which is provided with a thermal head, a head fixing member and a head self-aligning fulcrum shaft. The head fixing member is configured to fix the thermal head. The head self-aligning fulcrum shaft is attached to the head fixing member while being made to be substantially coincident with the center of gravity of the head fixing member. Further, the head self-aligning fulcrum shaft is pivotably or rotatably fixed to the head fixing member with a metal fixture.

SUMMARY

In a case that the thermal head is used for a predetermined period of time, the thermal head is worn due to the friction with respect to an ink ribbon, etc., and needs to be replaced, in some cases. In order to replace the thermal head, the head self-aligning fulcrum shaft needs to be removed from the metal fixture. Accordingly, in a case that the metal fixture is fixed to the head fixing member with a screw, etc., it is necessary to loosen the screw with a tool. Consequently, there is such a problem that the tool is necessary for replacing the thermal head and that the exchange cannot be performed easily. Further, since the pressing force is applied to the thermal head from the ink ribbon and/or a print medium, the construction for fixing the thermal head is required to be durable as well.

An object of the present disclosure is to provide a printing apparatus in which the thermal head can be replaced or exchanged easily and which is provided with a durable configuration for fixing the thermal head.

According to an aspect of the present disclosure, there is provided a printing apparatus including: a thermal head including a plurality of heating elements arranged in a first direction; a first engaging member provided on the thermal head; a head holder including a second engaging member which faces the first engaging member in a second direction crossing the first direction, and which is configured to engage with the first engaging member so that the thermal head is rotatable about a first axis line extending in the second direction, the head holder being configured to hold the thermal head in a posture in which the plurality of heating elements are oriented in a third direction crossing both of the first and second directions; a pair of urging members arranged in the head holder, with the second engaging member being intervened therebetween in the first direction, each of the pair of urging members including an end projecting toward the thermal head; a contacting member arranged in the thermal head and the end of each of the pair of urging members being brought into contact; and a locking part arranged in the contacting member on one side in the second direction, and configured to lock the end of each of the pair of urging members.

According to the printing apparatus of the present aspect, for example, by inclining the thermal head by not less than a predetermined angle about the first axis line, it is possible to release the locking of the end of each of the urging members which is locked by the locking part of the contacting member. Accordingly, the thermal head can be attached or detached without a tool. Further, since the thermal head is fixed by locking, to the locking part of the contacting member, the end of each of the urging members arranged in the head holding member, the configuration for fixing the thermal head is allowed to be simple, while making it possible to realize a durable configuration for fixing the thermal head.

DESCRIPTION OF THE EMBODIMENTS

In the following, an embodiment of the present disclosure will be explained with reference to the drawings. The following explanation will be given provided that a first direction, a second direction and a third direction of a printing apparatus 1 are the front-rear direction, the up-down direction and the left-right direction, respectively. The first direction, the second direction and the third direction of the present embodiment are orthogonal to one another. In the left-right direction, a direction in which a thermal head 3 (connector 38) is arranged with respect to a head holding member 4 is referred to as a head holding direction.

Figure 1:
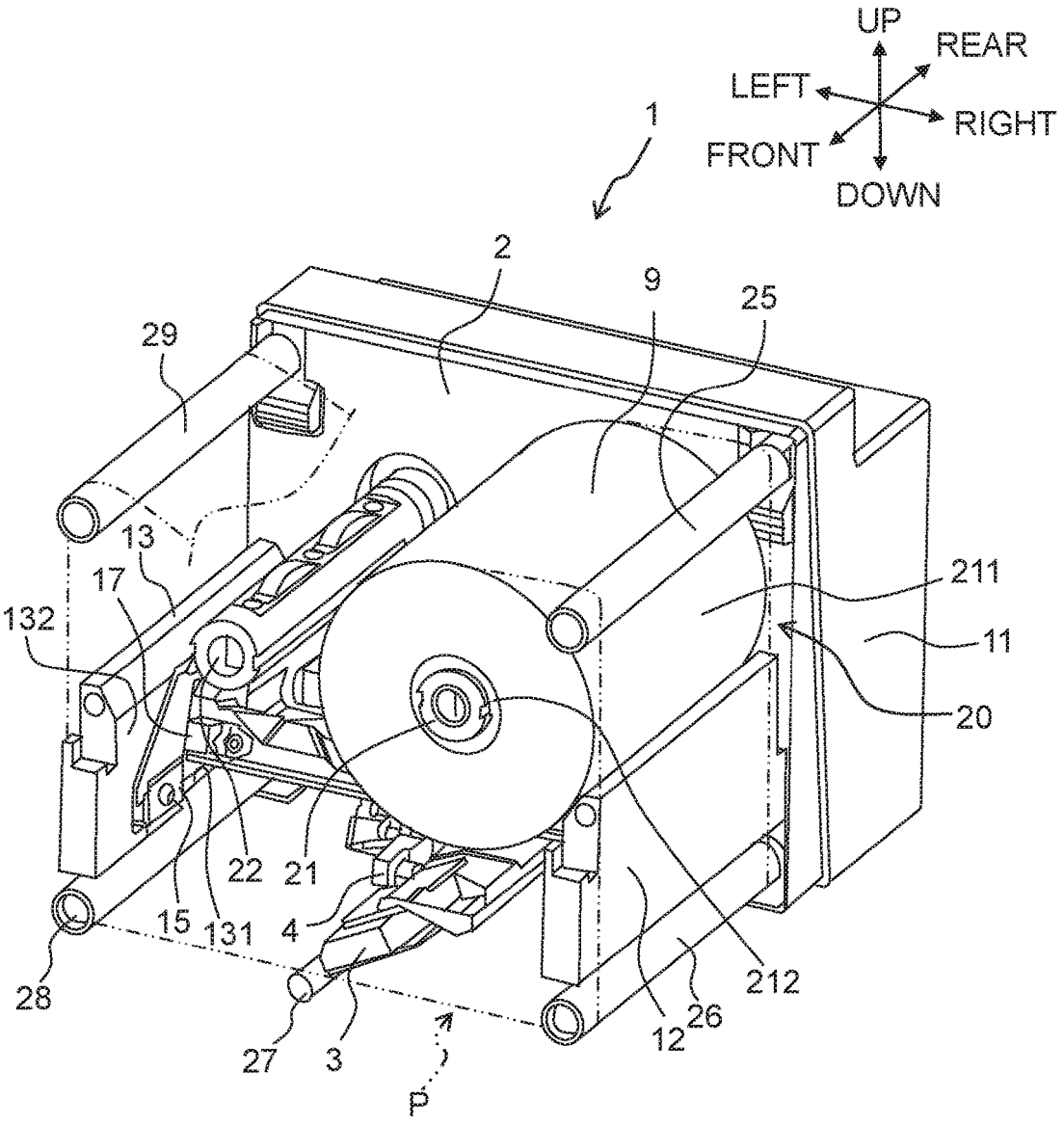
FIG. 1 is a perspective view of a printing apparatus 1.

A printing apparatus 1 depicted in FIG. 1 is a printing apparatus of the thermal-transfer type. The printing apparatus 1 is driven while being synchronized with a print medium conveying apparatus (not depicted in the drawings). The print medium conveying apparatus conveys an elongated print medium (not depicted in the drawings) in the left-right direction at a predetermined conveying velocity.

The print medium is, for example, a packaging material or a wrapping material which is formed to be a bag for containing foodstuffs therein. The printing apparatus 1 prints, for example, a letter text indicating a "best before date" on the print medium at a predetermined spacing distance.

Figure 2:
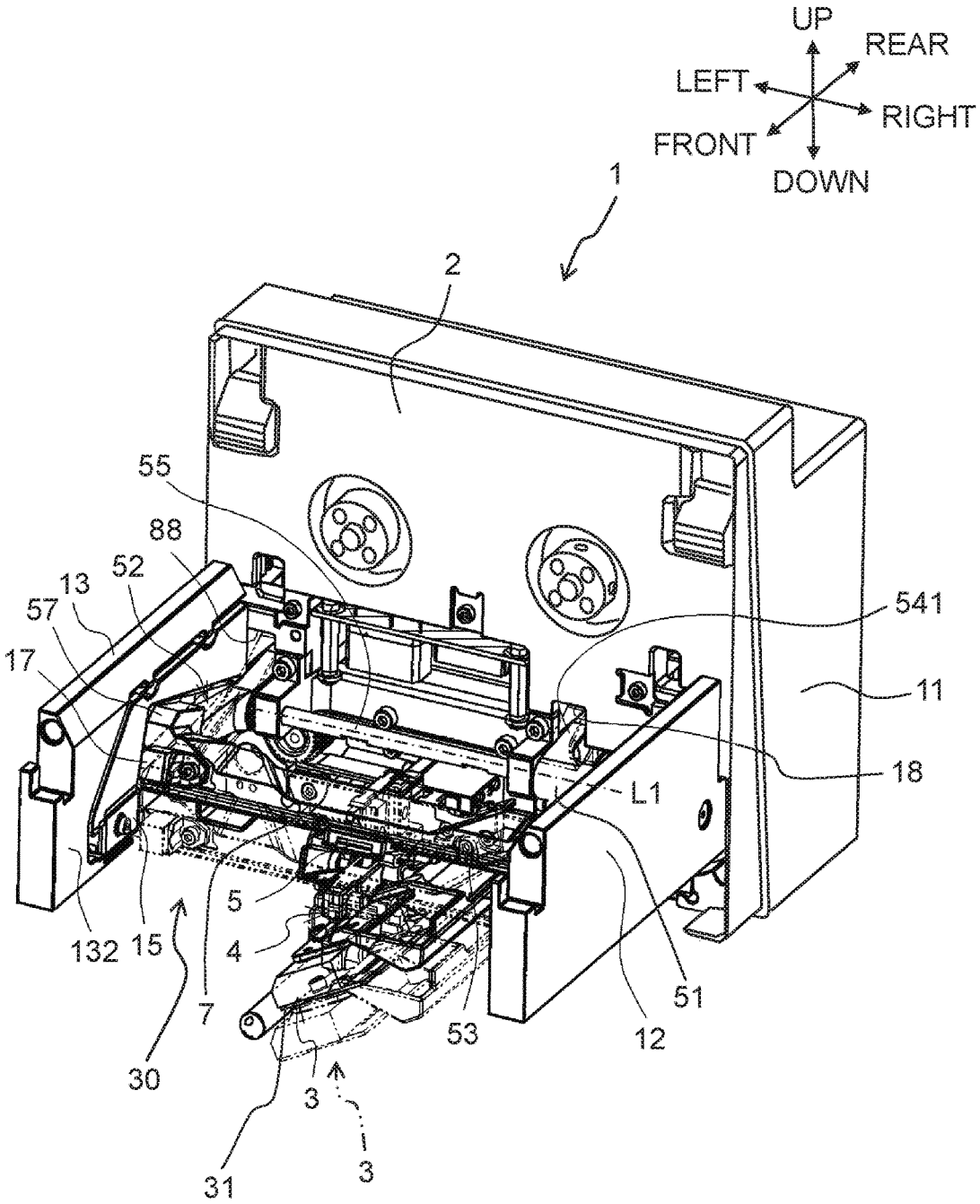
FIG. 2 is a perspective view of the printing apparatus 1 in a state that a ribbon conveying mechanism 20 is detached (removed).
Figure 3:
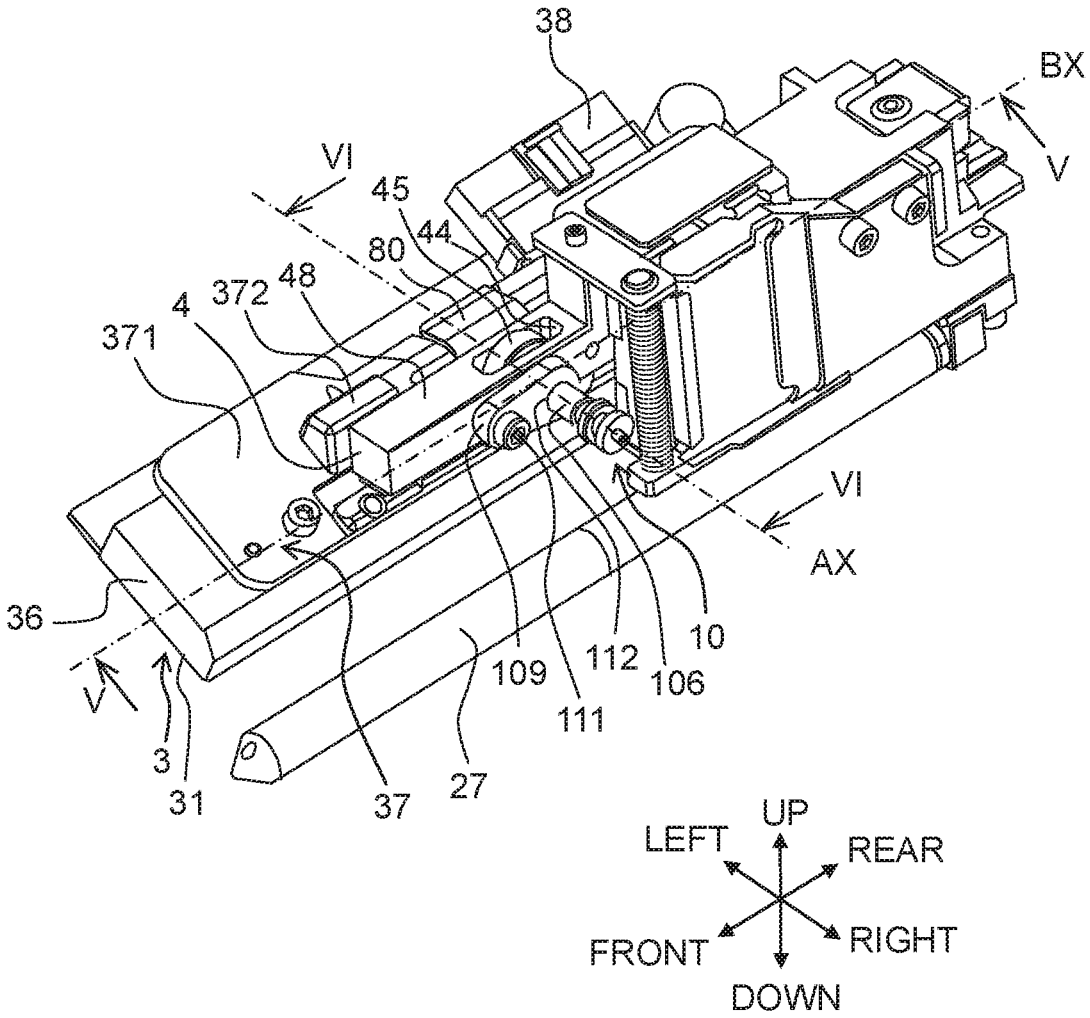
FIG. 3 is a perspective view of a thermal head 3, a head holding member 4, and a second engaging member 10.

As depicted in FIGS. 1 to 3, the printing apparatus 1 is provided with a base 2, the thermal head 3, the head holding member 4, and a second engaging member 10. The thermal head 3 is provided with a plurality of heating elements 31 arranged or aligned in the front-rear direction. The head holding member 4 is supported to be slidably movable with respect to the base 2 in the up-down direction crossing the front-rear direction. The second engaging member 10 is provided on the thermal head 3 or the head holding member 4, and connects or combines the thermal head 3 with respect to the head holding member 4 such that the thermal head 3 is attachable and detachable with respect to the head holding member 4, and that the thermal head 3 is slidably movable around the left-right direction crossing the front-rear direction and the up-down direction. The second engaging member 10 of the present embodiment is fixed to the head holding member 4. The printing apparatus 1 is further provide with a ribbon conveying mechanism 20, a moving assembly 30, and a moving mechanism 7. The ribbon conveying mechanism 20 holds an ink ribbon 9 and conveys the ink ribbon 9 in a predetermined conveyance direction. The moving assembly 30 moves the head holding member 4 in the up-down direction. The moving mechanism 7 moves the head holding member 4 in the left-right direction. In the following, respective parts, elements or components of the printing apparatus 1 will be explained in detail.

<Base 2>

The base 2 is a member supporting the respective constructive parts or elements provided on the printing apparatus 1 and including the thermal head 3 and the head holding member 4. The base 2 of the present embodiment is made of a rectangular metal plate. The base 2 is provided with through holes 18 and 88 penetrating the base 2 in the front-rear direction. The printing apparatus 1 is provided with a cover 11. The cover 11 has a box-shape covering the back surface side of the base 2. The printing apparatus 1 is provided with a first pillar 12 and a second pillar 13. Each of the first and second pillars 12 and 13 has a plate shape extending frontward from the front surface of the base 2. The first pillar 12 is connected to a right end part of the base 2. The second pillar 13 is connected to a left end part of the base 2. The first pillar 12 and the second pillar 13 are separated and away from each other in the left-right direction and extend in parallel to each other. Upper ends of the first and second pillars 12 and 13 are located in the vicinity of the center in the up-down direction of the base 2. The upper ends of the first and second pillars 12 and 13 are located above upper ends of the holes 18 and 88, respectively. The lower ends of the first and second pillars 12 and 13 are located above a lower end of the base 2.

<Ribbon Conveying Mechanism 20>

As depicted in FIG. 1, the ribbon conveying mechanism 20 of the printing apparatus 1 is provided with a first installing part 21, a second installing part 22, a first ribbon motor (not depicted in the drawings), a second ribbon motor (not depicted in the drawings), and guide shafts 25 to 29. Each of the first and second installing parts 21 and 22 is a shaft extending in the front-rear direction. The first and second installing parts 21 and 22 are rotatably supported on the front surface of the base 2. A first roll 211 is detachably installed in the first installing part 21 by allowing the first installing part 21 to be inserted into a hole in a cylindrical-shaped core shaft 212 of the first roll 211. A second roll (not depicted in the drawings) is detachably installed in the second installing part 22 by allowing the second installing part 22 to be inserted into a hole in a cylindrical-shaped core shaft (not depicted in the drawings) of the second roll. Namely, each of the first installing part 21 and the second installing part 22 is a spindle rotatably held in the base 2.

The ink ribbon 9 includes an ink layer and a base material (substrate), and has a strip-shape. The base material is formed, for example, of polyethylene terephthalate (PET). The ink layer includes, for example, a coloring component such as carbon, and a binder component such as wax and/or resin. The ink ribbon 9 is conveyed at a location below the thermal head 3 in such a posture that the ink layer is oriented toward (face) the print medium. The ink layer is melted by being heated, and is transferred onto the print medium. The ink ribbon 9 may have a functional layer or layers such as a back coat layer, a peel (releasing) layer, an adhesive layer, etc., as necessary. An end of the ink ribbon 9 is connected to the circumferential surface of the core shaft 212 of the first roll 211, and the other end of the ink ribbon 9 is connected to the circumferential surface of the core shaft of the second roll.

The guide shafts 25 to 29 define a conveyance route or path P of the ink ribbon 9. Each of the guide shafts 25 to 29 has a columnar shape; each of the guide shafts 25 to 29 is, for example, a roller rotatable about an axis of rotation extending in the front-rear direction. Each of the guide shafts 25, 26, 28 and 29 extends frontward from the front surface of the base 2, and a surface, of the ink ribbon 9, which is on the opposite side to the ink layer, makes contact with a part or portion of the circumferential surface of each of the guide shafts 25, 26, 28 and 29. The ink ribbon 9 is guided and conveyed by the respective guide shafts 25 to 29.

The first ribbon motor (not depicted in the drawings) and the second ribbon motor (not depicted in the drawings) are provided on the back surface of the base 2. The first ribbon motor rotates the first installing part 21. The second ribbon motor rotates the second installing part 22. Each of the first and second ribbon motors is, for example, a step motor capable of rotating in the normal and reverse directions. The first installing part 21 is directly connected to an output shaft of the first ribbon motor.

<Thermal Head 3>

As depicted in FIGS. 1 and 2, the thermal head 3 is arranged at a location in front of the front surface of the base 2 in the front-rear direction. The thermal head 3 is arranged at a location below the first installing part 21 and the second installing part 22. The thermal head 3 is a line thermal head provided with the plurality of heating elements 31 aligned in the front-rear direction. More specifically, the thermal head 3 has a configuration wherein a lower corner part of a plate-shaped ceramic substrate 36 which extends in the front/rear direction is chamfered (namely, a C chambering (chamfer plane)), and a graze layer and the plurality of heating elements 31 are provided on the ceramic substrate 36. The plurality of heating elements 31 are arranged along an edge part, of the thermal head 3, extending in the front-rear direction while being oriented downward, namely oriented toward the other side in the up-down direction, of the thermal head 3. The thermal head 3 is adjacent to the conveyance path P of the ink ribbon 9. In a case of performing printing by using the printing apparatus 1, the thermal head 3 is movable in the up-down direction by the moving assembly 30 between a position indicated by solid lines and a position indicated by virtual lines in FIG. 2. In a case that the thermal head 3 is arranged at a printing position located at a lower end part in a movable range in the up-down direction of the thermal head 3, the thermal head 3 approaches closely to or makes contact with a platen (not depicted in the drawings) which is arranged at a position below the thermal head 3.

Figure 4:
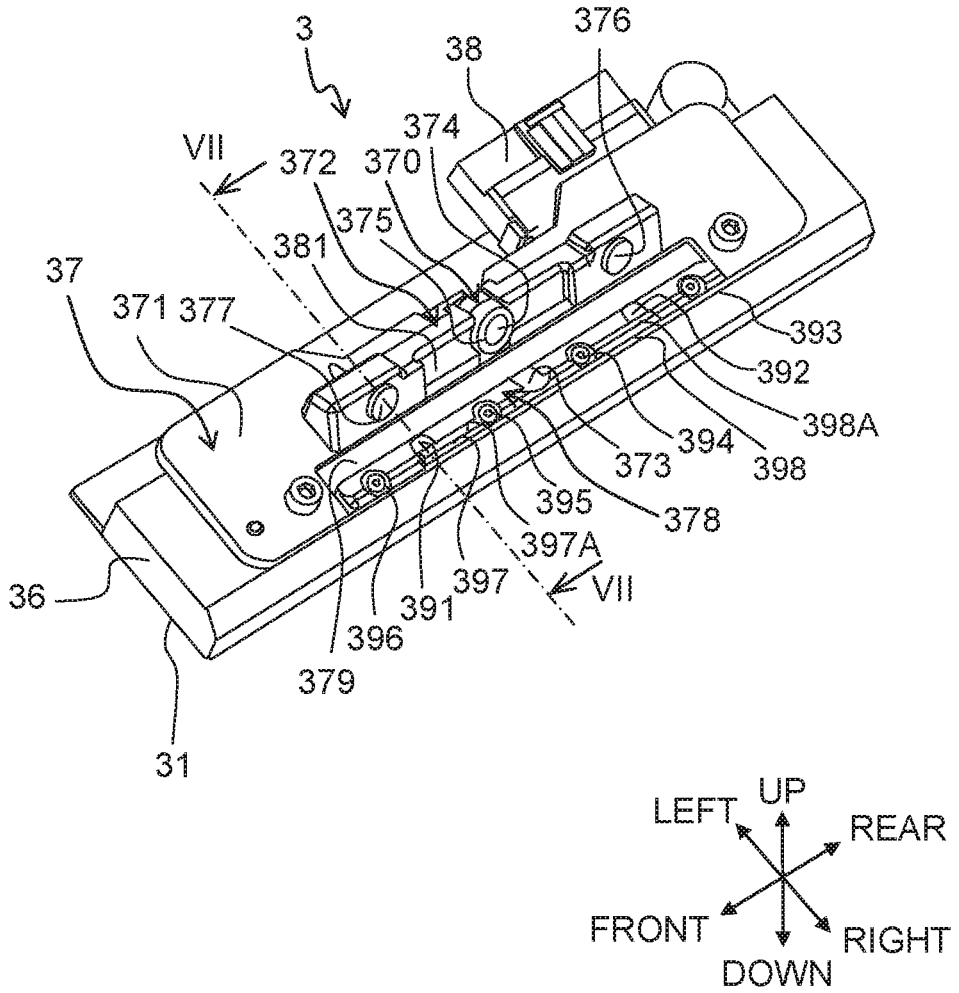
FIG. 4 is a perspective view of the thermal head 3.

The thermal head 3 is attached to the head holding member 4, by the second engaging member 10 (to be described later on), such that the head holding direction is changeable. In the following, the explanation regarding the respective members, etc., will be given with a case wherein the head holding direction is a leftward direction as depicted in FIG. 3, as the reference. As depicted in FIGS. 3 and 4, the thermal head 3 has the plurality of heating elements 31, the ceramic substrate 36, an installing part 37 and a connector 38. The ceramic substrate 36 has a shape which is a rectangular parallelepiped extending in the front-rear direction. The installing part 37 is connected (linked) to the upper surface of the ceramic substrate 36. The upper surface of the ceramic substrate 36 is a surface, of the ceramic substrate 36, on the opposite side to the surface (lower surface) on which the plurality of heating elements 31 are provided. A front end of the installing part 37 is located on the rear side of a front end of the ceramic substrate 36. A rear end of the installing part 37 is located on the front side of a rear end of the ceramic substrate 36. The center in the front-rear direction of the ceramic substrate 36 is substantially coincident with the center in the front-rear direction of the installing part 37.

As depicted in FIG. 4, the installing part 37 is provided with a plate-shaped part 371, a projected part 372 and a contacting member 374. The plate-shaped part 371 has a plate shape extending in the front-rear direction, and fixed to the upper surface of the ceramic substrate 36. The projected part 372 is a part, of the installing part 37, which is projected upward at a central portion in the front-rear direction and in the left-right direction of the plate-shaped part 371. The projected part 372 extends in the front-rear direction. The projected part 372 is provided with a facing surface 381, a first engaging member 370 and adjusting members 376 and 377. The facing surface 381 is a surface which is included in surfaces possessed by the projected part 372 and which faces the head holding member 4 in a case that the thermal head 3 is combined with the head holding member 4. The first engaging member 370 is provided with an insertion hole 374. The insertion hole 374 is a hole penetrating through the projected part 372 in the left-right direction at a substantially central location in the front-rear direction of the projected part 372. The insertion hole 374 of the present embodiment is provided on a central part of an extending range in the front-rear direction of the thermal head 3. A bearing 375 made of a metal or resin is fitted to the insertion hole 374. The bearing 375 may be formed of a member in which only a surface thereof is made of a resin and other part or portion different from the surface is formed of a member different from the resin. The resin material for forming the bearing 375 may be selected appropriately, and is exemplified, for example, by a polyacetal (POM) resin, a polyetheretherketone (PEEK) resin, a polyphenylene sulfide (PPS) resin, an ultrahigh molecular weight polyethylene (UHMW-PE) resin, etc.

The adjusting members 376 and 377 are columnar shaped and projecting members which are provided on the facing surface 381, and are arranged in the front-rear direction with respect to each other while sandwiching the insertion hole 374 of the first engaging member 370 therebetween in the front-rear direction. The adjusting members 376 and 377 are made of a resin. In the front-rear direction of the projected part 372, the insertion hole 374 of the first engaging member 370 is located equidistant from the adjusting members 376 and 377. In a case that the thermal head 3 is attached to the head holding member 4, each of the adjusting members 376 and 377 makes contact with the head holding member 4.

Figure 7:
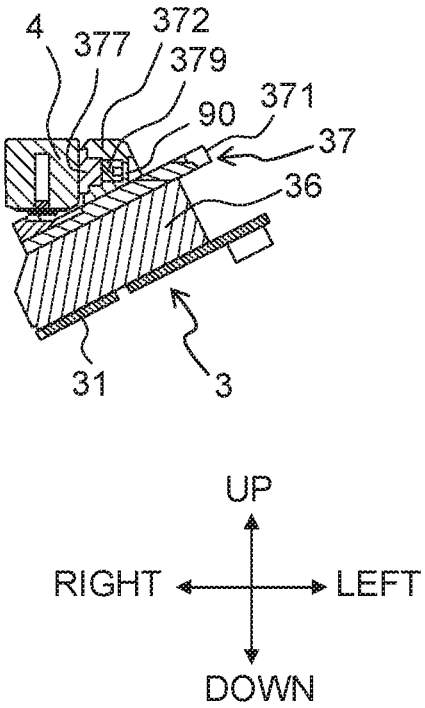
FIG. 7 is a cross-sectional view along a line VII-VII depicted in FIG. 4 and as seen from the direction of arrows in FIG. 4.

Note that as depicted in FIG. 7, a screw 90 configured to adjust a projection amount of the adjusting member 377 toward a side of the head holding member 4 is provided on a side of the rear surface (left side) of the adjusting member 377. An example of the screw 90 is a grub screw. The screw 90 is screwed in a screw hole 379 formed in the left-right direction in the projected part 372. A right end part of the screw 90 makes contact with a left end part of the adjusting member 377. Accordingly, by rotating the screw 90, the projection amount of the projected part 377 toward the side of the head holding member 4 can be adjusted. Note that although not depicted, another screw similar to the screw 90 is also provided on a side of the rear surface (left side) of the adjusting member 376.

Figure 5:
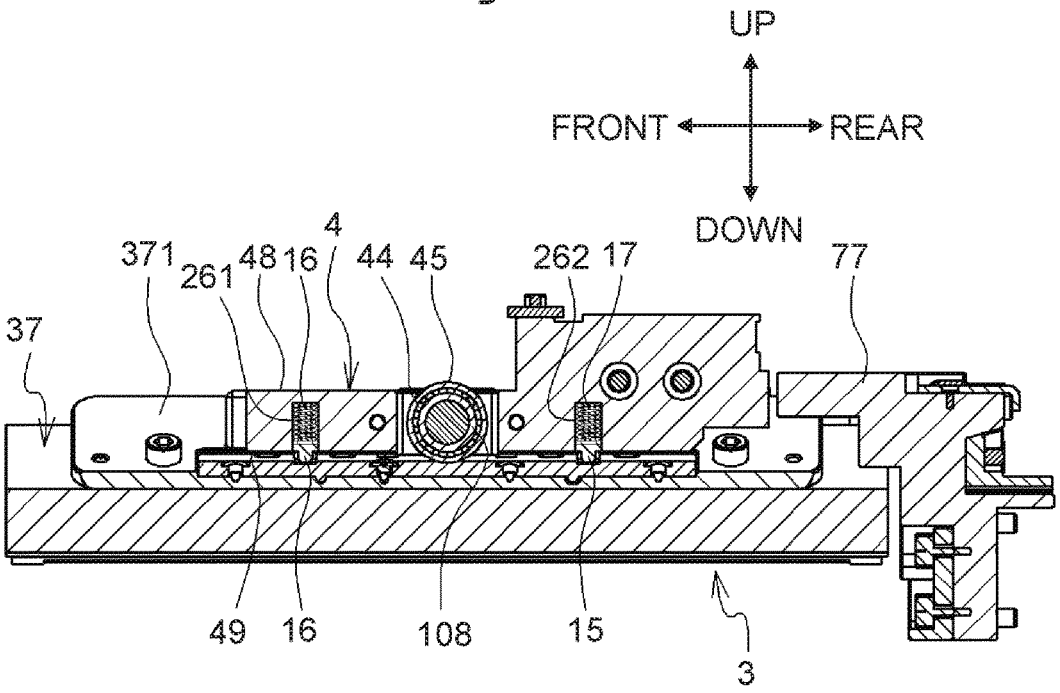
FIG. 5 is a cross-sectional view along a line V-V depicted in FIG. 3 and as seen from the direction of arrows in FIG. 3.
Figure 8A:
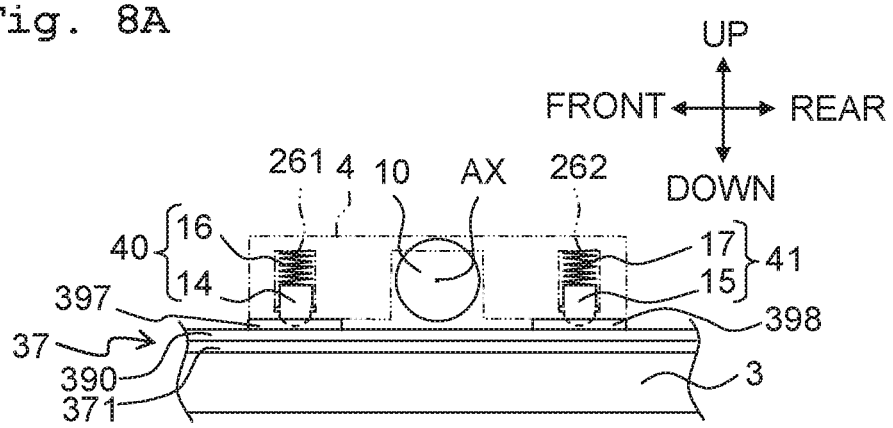
FIG. 8A is a schematic view depicting a case that the thermal head 3 attached to the head holding member 4 is at a reference position.

As depicted in FIG. 4, the contacting member 378 is a member which is formed of a resin, which is arranged on the right side with respect to the projected part 372 and which extends in the front-rear direction. The contacting member 378 is provide with a support part 373, contacting parts 391 and 392, and locking parts 397 and 398. The supporting part 373 is arranged at a location below the head holding member 4 and receives a rolling member 45 (to be described later on), in a case that the thermal head 3 is attached to the head holding member 4. The contacting parts 391 and 392 make contact with balance pins 14 and 15, respectively, which are provided on lower ends of urging members 16 and 17 (to be described later on; see FIGS. 5 and 8), respectively. The locking parts 397 and 398 are provided on right end portions of the contacting parts 391 and 392, respectively, of the contacting member 378. Each of the locking parts 397 and 398 is a projection having a predetermined length in the front-rear direction, a predetermined height in the up-down direction, and a predetermined width in the left-right direction. Further, the locking parts 397 and 398 are provided with inclined surfaces 397A and 398A, respectively. In a case that the posture around the left-right direction of the thermal head 3 with respect to the head holding member 4 is at a reference position (to be described later on) as depicted in FIG. 5, upper end portions of the locking parts 397 and 398 are located to be higher than the lower end parts of the balance pins 14 and 15, respectively, as depicted in FIG. 8A. Accordingly, the locking parts 397 and 398 perform locking for the thermal head 3 so as to prevent such a situation that the thermal head 3 is detached or removed from the head holding member 4 due to any movement of the thermal head 3 with respect to the head holding member 4 in the leftward direction that is a direction for the thermal head 3 to be separated and away with respect to the head holding member 4, which in turn would cause the second engaging member 10 to come off from the insertion hole 374 of the first engaging member 370.

Note that the contacting member 378 is fixed to the ceramic substrate 36 with screws 393, 394, 395 and 396 while sandwiching the plate-shaped part 371 between the contacting member 378 and the ceramic substrate 36. Further, the connector 38 extends leftward from a left rear part of the ceramic substrate 36. An end of a harness, which connects to the plurality of heating elements 31, is detachably connected to the connector 38. The other end of the harness is connected to a substrate (not depicted in the drawings) on which a controller (not depicted in the drawings) is provided.

<Head Holding Member 4>

Figure 8B:
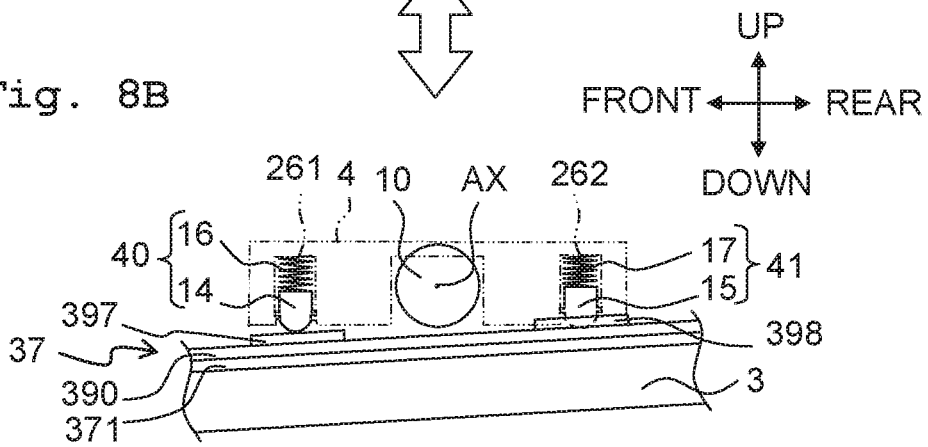
FIG. 8B is a schematic view depicting a case that a front side of the thermal head 3 attached to the head holding member 4 is lowered.
Figure 8C:
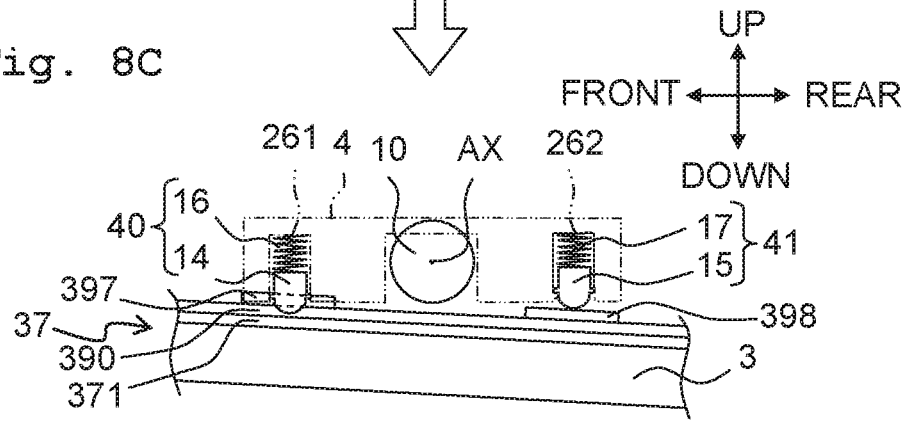
FIG. 8C is a schematic view depicting a state that the thermal head 3 is being detached from the head holding member 4.

As depicted in FIG. 3, the head holding member 4 is a prism or quadrangular prism-shaped member which is long in the front-rear direction. The head holding member 4 holds the thermal head 3 in such a manner that the inclination of the thermal head 3 (more specifically, of the plurality of heating elements 31) with respect to a plane in which the platen (not depicted in the drawings) is arranged and extends is adjustable. Returning mechanism 40 and 41 as depicted in FIGS. 8A to 8C are provided on the head holding member 4. In a case that any pressing force is not applied to the thermal head 3, the returning mechanism 40 and 41 return the posture around the left-right direction of the thermal head 3 with respect to the head holding mechanism 4 to the reference position. The phrase that a "case that a pressing force is applied to the thermal head 3" means, for example, such a case that the thermal head 3 is arranged at the printing position. The phrase that a "case that any pressing force is not applied to the thermal head 3" means, for example, such a case that the thermal head 3 is arranged at a stand-by position. The specifics of the printing position and the stand-by position will be described later on.

As depicted in FIGS. 8A to 8C, the returning mechanisms 40 and 41 have balance pins 14 and 15, insertion holes 261 and 262, and urging members 16 and 17, respectively. The balance pins 14 and 15 are each a columnar-shaped member which is made of metal and of which lower part is chamfered into a semi-circular shape. The balance pins 14 and 15 make contact with the thermal head 3 in a case that the posture of the thermal head 3 around the left-right direction with respect to the head holding member 4 is changed from the reference position in a state that the thermal head 3 and the head holding member 4 are combined by the second engaging member 10. In the printing apparatus 1 of the present embodiment, in a case that the posture of the thermal head 3 around the left-right direction with respect to the head holding member 4 is at the reference position, the posture depicted in FIG. 5 is provided. In the case that the posture of the thermal head 3 around the left-right direction with respect to the head holding member 4 is at the reference position, the extending direction of the thermal head 3 in the front-rear direction is substantially parallel to the conveyance path P of the ink ribbon 9. The insertion holes 261 and 262 are arranged symmetrically (symmetrized) with respect to the supporting part 373 in the front-rear direction. The insertion holes 261 and 262 accommodate the balance pins 14 and 15, respectively. The balance pins 14 and 15 are made of a same material, and have a same structure. The material of the balance pins 14 and 15 may be selected as appropriate and may be exemplified, for example, by aluminum alloy, stainless steel, etc.

The urging members 16 and 17 urge the balance pins 14 and 15, respectively, toward the thermal head 3 in a state that the thermal head 3 and the head holding member 4 are combined with the second engaging member 10. Lower end parts of the urging members 16 and 17 of the present embodiment are connected to the balance pins 14 and 15, respectively, and urge the balance pins 14 and 15, respectively, downwardly. Upper end parts of the urging members 16 and 17 are fixed to upper ends of the insertion holes 261 and 262, respectively. The balance pins 14 and 15 are urged by the urging members 16 and 17, respectively, and the lower ends of the balance pins 14 and 15 projects further downwardly than the lower surface 49 of the head holding member 4. The balance pins 14 and 15 of the present embodiment have a downward moving range which is defined by a stopper (not depicted in the drawings). There is defined a minute gap between the thermal head 3 and the balance pins 14 and 15 at the reference position; and the balance pins 14 and 15 are separated and away from the thermal head 3 due to this minute gap. The gap is provided in such a manner since if the balance pins 14 and 15 make contact with the thermal head 3 which is arranged at the reference position and thereby compress the urging members 16 and 17, there arises any difference in the load between the balance pins 14 and 15 due to any variation in the compression between the urging members 16 and 17, thereby causing the posture around the left-right direction of the thermal head 3 with respect to the head holding member 4 to incline with respect to the reference position, in some cases. In a case that the posture around the left-right direction of the thermal head 3 with respect to the head holding member 4 is changed from the reference position, any one of the balance pins 14 and 15 makes contact with the thermal head 3.

Figure 6:
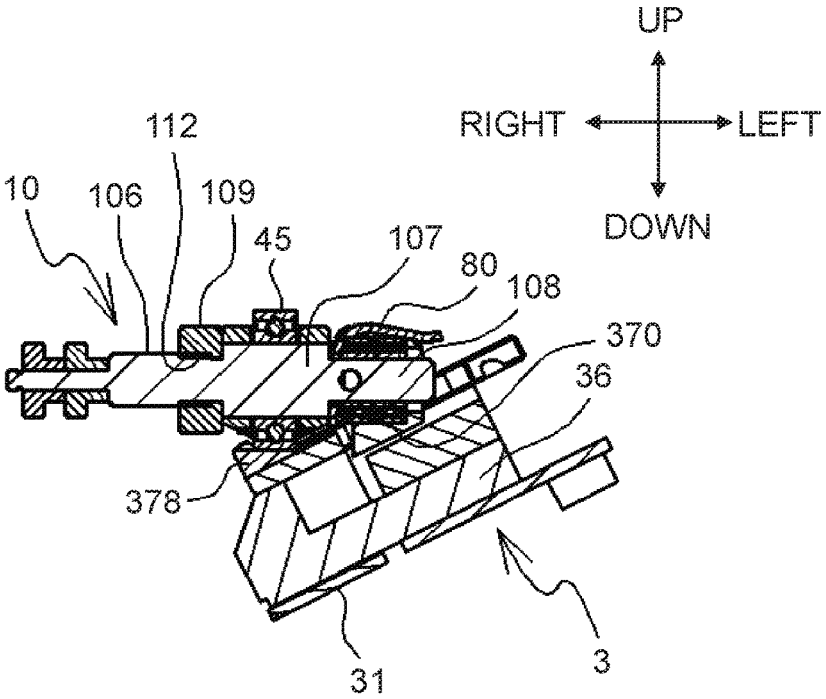
FIG. 6 is a cross-sectional view along a line VI-VI depicted in FIG. 3 and as seen from the direction of arrows in FIG. 3.

As depicted in FIG. 3, the head holding member 4 has a hole 44 which is open upwardly and which is provided on a substantially central part in the front-rear direction of the head holding member 4. A rolling member 45 is inserted into the hole 44 and is held by the head holding member 4 to be rotatable about an axis line extending in the left-right direction as the center of rotation. As depicted in FIG. 6, the rolling member 45 of the present embodiment allows a shaft part 107 of the second engaging member 10 to be inserted therethrough, and the rolling member 45 is held by the head holding member 4 to be rotatable about an axis line AX. An upper end part of the rolling member 45 projects upward to a location above or higher than an upper surface 48 of the head holding member 4. The upper surface 48 of the head holding member 4 is a surface included in surfaces possessed by the head holding member 4 and facing a head pressing member 5 (to be described later on). It is allowable that the upper end part of the rolling member 45 projects upward to the location above the upper end of the head holding member 4, or that the upper end part of the rolling member 45 does not project upward to the location above the upper end of the head holding member 4.

The rolling member 45 makes contact with a contact surface (not depicted in the drawings) of the head pressing member 5 which is the lower surface of the head pressing member 5, and is pressed downward by the head pressing member 5. The hole 44 of the present embodiment is open also downwardly. Namely, the hole 44 of the present embodiment penetrates through the head holding member 4 in the up-down direction. A lower end part of the rolling member 45 projects downward to a location below or lower than the lower surface 49 of the head holding member 4. The lower surface 49 of the head holding member 4 is a surface included in the surfaces possessed by the head holding member 4 and is on a side facing the thermal head 3. It is allowable that the lower end part of the rolling member 45 projects downward to the location below the lower end of the head holding member 4, or that the lower end part of the rolling member 45 does not project downward to the location below the lower end of the head holding member 4.

In a case that the thermal head 3 and the head holding member 4 are combined by the second engaging member 10 as depicted in FIG. 3, the supporting part 373 (see FIG. 4) of the thermal head 3 receives the rolling member 45 from therebelow. The length in the left-right direction of the contacting part 373 is longer than the length in the left-right direction of the rolling member 45. In a case that the rolling member 45 is pressed downward by the head pressing member 5, the pressing force from the head pressing member 5 is transmitted to the plurality of heating elements 31 via the supporting part 373. Namely, in a case that the rolling member 45 is pressed downward by the head pressing member 5, the pressing force from the head pressing member 5 is applied to the thermal head 3. The rolling member 45 of the present embodiment is a bearing.

In a case that the thermal head 3 and the head holding member 4 are combined, it is preferred that the head holding member 4 is made to be substantially coincident, in the front-rear direction, with the center of gravity of the thermal head 3. The center of gravity of the thermal head 3 of the present embodiment is substantially coincident with the central position in the front-rear direction. As depicted in FIG. 3, the position in the front-rear direction of the axis line AX is substantially coincident with the center of gravity in the front-rear direction of the thermal head 3.

Further, as depicted in FIG. 3, the head holding member 4 is provided with a head urging member 80 configured to downwardly urge a part or portion, of the thermal head, 3 on the left side in the left-right direction of the thermal head 3. The head urging member 80 is constructed of a bent metal plate. The head urging member 80 may be a bent leaf spring, etc. A perpendicular part of the head urging member 80 is fixed to the head holding part 4, and an upper portion, of the head urging member 80, which is bent leftward urges the upper surface of the projected part 372 downward.

<Second Engaging Member 10>

As depicted in FIG. 6, the second engaging member 10 is detachably provided on the head holding member 4, and is provided with, from the left side, an axis part 106, an axis part 107 and an axis part 108. The second engaging member 10 of the present embodiment is constructed of a plurality of metals such as stainless steel, carbon steel for machine construction, free-cutting steel product, etc. The second engaging member 10 is a columnar-shaped member which is provided on the head holding member 4 and which extends in the left-right direction. The axis line extending in the longitudinal direction of the second engaging member 10 of the present embodiment is referred to as the axis line AX (see FIG. 3). In the second engaging member 10 of the present embodiment, the right side and left side of the second engaging member 10 are also referred to as a front end side and a rear end side, respectively, of the second engaging member 10. Namely, the shaft part 108 of the second engaging member 10 is a part on the left side of the second engaging member 10; the shaft part 108 has a columnar-shape extending in the left-right direction. The shaft part 108 is a rear end part in the head holding direction of the second engaging member 10. The shaft part 107 is a central part in the left-right direction of the second engaging member 10, and has a columnar shape of which diameter is greater than that of the shaft part 108. The shaft part 106 is a part on the right side of the second engaging member 10, and has a columnar shape of which diameter is smaller than that of the shaft part 108.

A fixing part 109 as depicted in FIGS. 3 and 6 is fixed to the shaft part 106. The fixing part 109 is a plate-shaped member having an elliptical shape which is long in the front-rear direction. The fixing part 109 has a hole 112 arranged on the rear side of the shaft part 106 and penetrating the fixing part 109 in the left-right direction. A screw 111 (see FIG. 3) configured to fix the second engaging member 10 to the head holding member 4 is inserted in the hole 112. In a case that the second engaging member 10 is attached to the head holding member 4 with the screw 111, the positions of the shaft parts 106 to 108 with respect to the head holding member 4 are determined, and any rotation of the second engaging member 10 about the shaft parts 106 to 108 are suppressed. By removing the screw 111, the second engaging member 10 becomes to be removable (detachable) with respect to the head holding member 4.

<Moving Assembly 30>

As depicted in FIGS. 1 and 2, the moving assembly 30 is provided with the head pressing member 5, a first moving mechanism (not depicted in the drawings), a first rotating member 51, a second rotating member 52 and a guide rail 53. The head pressing member 5 is arranged at a position above the head holding member 4. The head pressing member 5 is supported on the base 2 to be rotatable (pivotable) about a stick-shaped shaft 55 having an axis line L1 extending in the left-right direction; the head pressing member 5 downwardly presses the head holding member 4 from thereabove. Specifically, the head pressing member 5 downwardly presses the rolling member 45 from thereabove. The head pressing member 5 of the present embodiment is held by the guide rail 53 to be slidably movable in the left-right direction with respect to the base 2, and faces the thermal head 3 from thereabove. It is allowable to use, for example, a commercially available linear guide as the head pressing member 5 and the guide rail 53. In this case, the head pressing member 5 is a table attached to the guide rail 53. The first moving mechanism is provided with a first motor (not depicted in the drawings), and rotates the first rotating member 51 and the second rotating member 52 about the axis line L1 extending in the left-right direction. The axis line L1 is located in front of the base 2. The first rotating member 52 and the second rotating member 52 are extended from the base 2 from a location behind the base 2 up to a location in front of the base 2, and are supported on the base 2 to be rotatable about the axis line L1 parallel to the left-right direction. The first rotating member 51 is inserted in the hole 18 of the base 2. The second rotating member 52 is inserted in the hole 88 of the base 2. The guide rail 53 is connected to a front end of the first rotating member 5 and to a front end of the second rotating member 52, and extends in the left-right direction.

<Moving Mechanism 7>

The moving mechanism 7 has a second motor (not depicted in the drawings) and causes the head holding member 4 to move in the left-right direction by driving the second motor 4. The second motor has an output shaft extending tin the frontward direction as one side of the front-rear direction. Although not depicted, the moving mechanism 7 has a first pulley, a second pulley and a belt. The first pulley is connected to the output shaft of the second motor. The second pulley is separated away from the first pulley in the leftward direction. The belt is combined to the head holding member 4 via a slidably movable member, and is stretched between the first pulley and the second pulley. The diameter of the first pulley is substantially same as that of the second pulley. A slidably movable member 77 (see FIG. 5) is connected to the rear end part of the head holding member 4, and is held, by a guide rail, to be slidably movable in the left-right direction with respect to the base 2. The guide rail extends in the left-right direction. It is allowable to use, for example, a commercially available linear guide as the slidably movable member 77 and the guide rail. In this case, the slidably movable member 77 is a table attached to the guide rail.

<Printing Position, Stand-by Position and Retract Position of Thermal Head 3>

In a print stand-by state, the thermal head 3 is arranged at the stand-by position. In a case that the thermal head 3 is arranged at the stand-by position, the urging members 16 and 17 apply substantially a same force to the thermal head 3. As schematically depicted in FIG. 8A, the stand-by position is a position at which a lower end part of the thermal head 3 is separated away from the platen (not depicted in the drawings), and makes contact with or approaches closely to the ink ribbon 9 extending in the left-right direction. The stand-by position is set to be a position which is located below the upper end of the moving range in the up-down direction of the thermal head 3 and at which the thermal head 3 is separated away from the ink ribbon 9. In the present embodiment, the position at which the thermal head 3 is separated away from the ink ribbon 9 is a position at which the lower end of the thermal head 3 is located above a line connecting the lower ends of the guides shafts 26 and 28, namely a part or portion of the conveyance path P of the ink ribbon 9 located between the guide shafts 26 and 28 as depicted in FIG. 1. The printing position is a position at which the lower end part of the thermal head 3 makes contact with the platen in a state that the print medium is not arranged between the thermal head 3 and the platen.

<Detachment of Thermal Head 3>

In a case that a printing operation is continued for a predetermined period of time, the heating elements 31 are worn and the thermal head 3 needs to be replaced, in some cases. In the following, an explanation will be given with reference to FIGS. 8A to 8C, about the detachment of the thermal head 3. In a case that the posture around the left-right direction of the thermal head 3 with respect to the head holding member 4 is at the reference position, upper end portions of the locking parts 397 and 398 are located at positions which are higher than the lower ends of the balance pins 14 and 15, respectively, as depicted in FIG. 8A. Accordingly, the locking parts 397 and 398 lock the lower end parts of the balance pins 14 and 15 such that the thermal head 3 does not move in the leftward direction with respect to the head holding member 4 and that the thermal head 3 is not separated away from the head holding member 4. Consequently, the second engaging member 10 is prevented from coming off from the insertion hole 374 of the first engaging member 370 and the thermal head 3 is prevented from coming off or being detached.

From this state, for example as depicted in FIG. 8B, a user downwardly presses a part or portion, of the thermal head 3, on the front end side thereof by a predetermined amount and causes the thermal head 3 to rotate counterclockwise by not less than a predetermined angle about the axis line AX of the second engaging member 10, so as to incline the thermal head 3. Then, the end (lower end) of the balance pin 14 comes to a position at which the lower end climbs over the upper portion of the locking part 397; thus, in a case that the user pushes or presses the thermal head 3 in the leftward direction with respect to the head holding member 4, the end of the balance pin 14 is guided by the inclined surface 397A (see FIG. 4) and climbs over the locking part 397.

Next, the user downwardly presses a part or portion, of the thermal head 3, on the rear end side thereof by a predetermined amount as depicted in FIG. 8C, and causes the thermal head 3 to rotate clockwise by not less than a predetermined angle about the axis line AX of the second engaging member 10, so as to incline the thermal head 3. Then, the end (lower end) of the balance pin 15 comes to a position at which the lower end climbs over the upper portion of the locking part 398; thus, in a case that the user presses the thermal head 3 in the leftward direction with respect to the head holding member 4, the end of the balance pin 15 is guided by the inclined surface 398A (see FIG. 4) and climbs over the locking part 398. In this aspect, the user pulls the second engaging member 10 of the thermal head 3 from the insertion hole 374 of the first engaging member 370 of the head holding member 4, thereby making it possible to detach the thermal head 3 from the head holding member 4.

Next, the user removes the harness (not depicted in the drawings) from the connector 38 of the thermal head 3, thereby making it possible to replace the thermal head 3. Note that the detachment of the thermal head 3 may be performed as follows, namely: by firstly pressing downwardly a part or portion, of the thermal head 3, on the rear end side thereof by a predetermined amount, and causing the thermal head 3 to rotate clockwise by not less than a predetermined angle about the axis line AX of the second engaging member 10, to thereby release the locking of the end (lower end) of the balance pin 15 with the locking part 398; then by pressing downwardly a part or portion, of the thermal head 3, on the front end side thereof by a predetermined amount, and causing the thermal head 3 to rotate counterclockwise by not less than a predetermined angle about the axis line AX of the second engaging member 10, to thereby release the locking of the end (lower end) of the balance pin 14 with the locking part 397.

<Attachment of Thermal Head 3>

Next, an explanation will be given about the attachment of the thermal head 3. The user inserts the second engaging member 10 of the thermal head 3 into the insertion hole 374 of the first engaging member 370 of the head holding member 4; and then for example as depicted in FIG. 8C, the user presses downwardly the part or portion, of the thermal head 3, on the rear end side thereof by the predetermined amount and causes the thermal head 3 to rotate clockwise by not less than the predetermined angle about the axis line AX of the second engaging member 10, so as to incline the thermal head 3. Then, the end (lower end) of the balance pin 15 comes to the position at which the lower end climbs over the upper portion of the locking part 398; thus, in a case that the user presses the thermal head 3 in the rightward direction with respect to the head holding member 4, the end of the balance pin 15 climbs over the locking part 398 and thus the end of the balance pin 15 is locked by the locking part 398.

Next, for example as depicted in FIG. 8B, the user presses downwardly the part or portion, of the thermal head 3, on the front end side thereof by the predetermined amount, and causes the thermal head 3 to rotate counterclockwise by not less than the predetermined angle about the axis line AX of the second engaging member 10, so as to incline the thermal head 3. Then, the end (lower end) of the balance pin 14 comes to the position at which the lower end climbs over the upper portion of the locking part 397; thus, in a case that the user presses the thermal head 3 in the rightward direction with respect to the head holding member 4, the end of the balance pin 14 climbs over the locking part 397 and thus the end of the balance pin 15 is locked by the locking part 398. Accordingly, as depicted in FIG. 8A, the upper end portions of the locking parts 397 and 398 are located at the positions which are higher than the lower end parts of the balance pins 14 and 15, respectively, as depicted in FIG. 8A. Accordingly, the locking parts 397 and 398 lock the lower end parts of the balance pins 14 and 15 so as not to allow the thermal head 3 to move in the leftward direction, as the direction in which the thermal head 3 is separated away with respect to the head holding member 4, and so as not to allow the second engaging member 10 to come off from the insertion hole 374 of the first engaging member 370, thereby making it possible to prevent the thermal head 3 from coming off or being detached. Note that the attachment of the thermal head 3 may be performed as follows, namely: by firstly pressing downwardly the part or portion, of the thermal head 3, on the front end side thereof by the predetermined amount, and causing the thermal head 3 to rotate counterclockwise by not less than the predetermined angle about the axis line AX of the second engaging member 10, so as to incline the thermal head 3 to thereby allow the end (lower end) of the balance pin 14 to lock with the locking part 397; then by pressing downwardly the part or portion, of the thermal head 3, on the rear end side thereof by the predetermined amount, and causing the thermal head 3 to rotate clockwise by not less than the predetermined angle about the axis line AX of the second engaging member 10, so as to incline the thermal head 3 to thereby allow the end (lower end) of the balance pin 15 to lock with the locking part 398.

In the printing apparatus 1, the locking of the balance pins 14 and 15 as the front ends of the urging members 16 and 17 locked by the locking parts 397 and 398, respectively, of the contacting member 378 may be released by inclining the thermal head 3 by not less than the predetermined angle about the axis line AX. Accordingly, it is possible to attach and detach the thermal head without requiring any tool. Further, since the thermal head 3 is fixed by locking the balance pins 14 and 15 as the front ends of the urging members 16 and 17 which are provided on the head holding member 4 with the locking parts 397 and 398, respectively, of the contacting member 378, the configuration for fixing the thermal head 3 is allowed to be simple, thereby making it possible to realize a durable configuration for fixing the thermal head 3.

By pulling the balance pin 14 as the end of the urging member 16 and the balance pin 15 as the end of the urging member 17 along the inclined surface 397A and the inclined surface 378A, respectively, of the locking part 397, in the second direction (upward direction), it is possible to release the locking of the balance pin 14 as the end of the urging member 16 and the locking of the balance pin 15 as the end of the urging member 17.

In the printing apparatus 1, the thermal head 3 is provided with the projected part 372 which is configured to hold the first engaging member 370. Further, the adjusting members 376 and 377 are provided on the projected part 372 while sandwiching the first engaging member 370 therebetween in the front-rear direction of the projected part 372. The screw 90 configured to adjust the projection amount of each of the adjusting members 376 and 377 toward the side of the head holding member 4 is provided on the side of the rear surface (left side) of each of the adjusting members 376 and 377. Accordingly, in such a case that the thermal head 3 is attached to the head holding member 4 and that any gap is defined between the adjusting members 376 and 377 of the projected part 372 and the head holding member 4, thereby allowing any looseness or allowance therebetween, it is possible to adjust, with the screw 90, the projection amount of each of the adjusting members 376 and 377 toward the side of the head holding member 4. Accordingly, it is possible to prevent any rattling of the thermal head 3 with respect to the head holding member 4.

In the printing apparatus 1, as depicted in FIG. 3, the head holding member 4 is provided with the head urging member 80 configured to urge downwardly the part or portion, of the thermal head, 3 on the left side in the left-right direction of the thermal head 3. Accordingly, since the part on the left side in the left-right direction of the thermal head 3 is urged downwardly by the head urging member 80, it is possible to prevent the thermal head 3 to rotate about the left-right direction of the thermal head 3 as an axis line BX (see FIG. 3).

In the embodiment, the front-rear direction is an example of the "first direction" of the present disclosure; the left-right direction is an example of the "second direction" of the present disclosure; the up-down direction is an example of the "third direction" of the present disclosure; the axis line AX is an example of the "first axis line" of the present disclosure; the projected part 372 configured to hold the first engaging member 370 is an example of the "holding member" of the present disclosure; and the urging members 16 and 17 are each an example of the "urging member" of the present disclosure.

The printing apparatus of the present disclosure is not limited to or restricted by the embodiment as described above, and a variety of changes may be added to the embodiment in a range not departing from the gist and/or sprit of the present disclosure. For example, the above-described configuration of the printing apparatus 1 may be changed as appropriate. The first direction, the second direction and the third direction of the printing apparatus 1 may be changed as appropriate. It is allowable that the first direction, the second direction and the third direction cross with one another, and that the first, second and third direction are not orthogonal to one another. The printing apparatus 1 may be provided with a print medium conveying device configured to convey the print medium. The configurations of the print medium and the ink ribbon 9 may be changed as appropriate. The driving source for driving the respective members may be changed as appropriate. The conveyance path P of the ink ribbon 9 in the printing apparatus 1 may be changed as appropriate. A device configured to convey the ink ribbon may be provided, separately from the printing apparatus 1. The printing apparatus may be provided with a platen. The base may be a member having convex and concave portions (irregularities) in a surface thereof, or may be a member having a curved surface. The base may be box-shaped. The configurations of the moving assembly 30 and the moving mechanism 7 may be changed as appropriate. The moving assembly 30 may have a configuration provided with a fork assembly described in the specification of the U.S. Pat. No. 8,937,634. It is allowable that the moving mechanism 7 may be omitted in the printing apparatus 1, as necessary.

With respect to the returning mechanism(s), the configuration of the returning mechanism(s) may be changed as appropriate, and may have a configuration different from that provided with the balance pins and the pair of urging members. In the second engaging member 10, the shaft parts 106 to 108 and the insertion part 102 may have a same outer diameter, or may have mutually different outer diameters. The printing apparatus 1 may be configured such that the head holding direction is unchangeable.

What is claimed is:

1. A printing apparatus comprising:

a thermal head including a plurality of heating elements arranged in a first direction;

a first engaging member provided on the thermal head;

a head holder including a second engaging member which faces the first engaging member in a second direction crossing the first direction, and which is configured to engage with the first engaging member so that the thermal head is rotatable about a first axis line extending in the second direction, the head holder being configured to hold the thermal head in a posture in which the plurality of heating elements are oriented in a third direction crossing both of the first and second directions;

a pair of urging members arranged in the head holder, with the second engaging member being intervened therebetween in the first direction, each of the pair of urging members including an end projecting toward the thermal head;

a contacting member arranged in the thermal head and the end of each of the pair of urging members being brought into contact; and a locking part arranged in the contacting member on one side in the second direction, and configured to lock the end of each of the pair of urging members.

2. The printing apparatus according to claim 1, wherein the locking part includes an inclined surface arranged on the other side in the second direction.

3. The printing apparatus according to claim 1, further comprising:

a holder arranged in the thermal head and configured to hold the first engaging member; and a pair of adjusting members arranged in the holder, with the first engaging member being intervened therebetween in the first direction, each of the pair of adjusting members including an end part projecting toward the head holder and being brought into contact with the head holder, and a projecting amount of the end part being adjustable.

4. The printing apparatus according to claim 3, wherein each of the pair of adjusting members includes an adjusting screw configured to adjust the projecting amount of the end part of each of the pair of adjusting members.

5. The printing apparatus according to claim 1, wherein the head holder includes a head urging member configured to urge, in the third direction, a part, of the thermal head, on the other side in the second direction.

6. The printing apparatus according to claim 1, wherein the locking part is configured to release locking of the end of each of the pair of urging members, in a case that the thermal head is rotated about the first axis line by not less than a predetermined angle.

* * * * *